United States Patent [19]

Rankel

[11] Patent Number: 4,601,816

[45] Date of Patent: Jul. 22, 1986

[54] UPGRADING HEAVY HYDROCARBON OILS USING SODIUM HYPOCHLORITE

[75] Inventor: Lillian A. Rankel, Princeton, N.J.

[73] Assignee: Mobil Oil Corporation, New York, N.Y.

[21] Appl. No.: 639,058

[22] Filed: Aug. 9, 1984

[51] Int. Cl.[4] ..... C10G 29/04

[52] U.S. Cl. ..... 208/253; 208/190; 208/226; 208/230

[58] Field of Search ..... 208/253, 230, 226, 190

[56] References Cited

U.S. PATENT DOCUMENTS

| | | | |
|---|---|---|---|
| 1,776,340 | 1/1930 | Thole et al. | 208/190 |
| 1,930,216 | 10/1933 | Weber | 208/230 |
| 2,771,402 | 11/1956 | Birch et al. | 208/190 |
| 2,903,422 | 9/1959 | Van Beest et al. | 208/190 |
| 3,294,678 | 12/1966 | Gleim | 208/253 |
| 3,387,941 | 6/1968 | Murphy et al. | 208/230 |
| 3,660,512 | 5/1972 | Hamby et al. | 208/230 |
| 4,395,330 | 7/1983 | Auboir et al. | 208/309 |
| 4,421,639 | 12/1983 | Lambert et al. | 208/301 |

FOREIGN PATENT DOCUMENTS

| | | | |
|---|---|---|---|
| 540966 | 5/1957 | Canada | 208/190 |
| 216918 | 6/1924 | United Kingdom | 208/226 |
| 378010 | 8/1932 | United Kingdom | 208/230 |
| 700551 | 12/1953 | United Kingdom | 208/190 |
| 743425 | 1/1956 | United Kingdom | 208/230 |

*Primary Examiner*—William R. Dixon, Jr.
*Assistant Examiner*—Cynthia A. Prezlock
*Attorney, Agent, or Firm*—Alexander J. McKillop; Michael G. Gilman

[57] ABSTRACT

Hydrocarbon oils, particularly petroleum residua, are demetallized by contacting the oil first with an aqueous solution of a hypochlorite such as sodium hypochlorite or calcium hypochlorite and subsequently subjecting at least the oil fraction thereof to a solvent deasphalting step.

20 Claims, No Drawings

UPGRADING HEAVY HYDROCARBON OILS USING SODIUM HYPOCHLORITE

NATURE OF THE INVENTION

This invention relates to the demetallation of hydrocarbon feedstocks. More particularly, it relates to an improved method of noncatalytic demetallation of hydrocarbon feedstocks using an aqueous hypochlorite solution.

DESCRIPTION OF THE PRIOR ART

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes being present.

The high metals content of the residual fractions generally precludes their effective use as chargestocks for subsequent catalytic processing such as catalytic cracking and hydrocracking, because the metal contaminants deposit on the special catalyst for these processes and cause the formation of inordinate amounts of coke, dry gas and hydrogen.

The amount of metals present in a given hydrocarbon stream is often expressed as a chargestock's "metal factor". This factor is equal to the sum of the metals concentrations, in parts per million, of iron and vanadium plus 10 times the concentration of nickel and copper in parts per million and is expressed in equation form as follows:

$$F_m = Fe + V + 10(NI + CU)$$

Conventionally a chargestock having a metals factor of 2.5 or less is considered particularly suitable for catalytic cracking. Nonetheless, streams with a metals factor of 2.5–25 or even 2.5–50, may be used to blend with, or as all of the feedstock to a catalytic cracker, since chargestocks with metals factors greater than 2.5 in some circumstances may be used to advantage, for instance, with the newer fluid cracking techniques.

In any case, the residual fractions of typical crudes require treatments to reduce the metals factor. For example, a typical Kuwait crude, considered of average metals content, has a metals factor of about 75 to about 100. As almost all the metals are combined with the residual fraction of a crudestock, it is clear that at least about 80 percent of the metals and preferably at least 90 percent, needs to be removed to product fractions (having a metals factor of about 2.5–50) suitable for cracking chargestocks. It is also desirable to remove metals from hydrotreating feedstocks to avoid catalyst poisoning. Accordingly, it is a main object of the present invention to provide an improved method for upgrading heavy hydrocarbon oils for use as liquid fuels or as demetallized feedstocks for refinery cracking operations. It is a further object of this invention to provide a method for removing from heavy hydrocarbon oils the metal content present therein.

Other objects and advantages of the present invention will become apparent from the accompanying description and illustrated data.

SUMMARY OF THE INVENTION

One or more objects of the present invention are accomplished by removing at least a portion of the metals content from a hydrocarbon liquid feedstream by contacting the stream with an aqueous solution of a hypochlorite, such as sodium hypochlorite or calcium hypochlorite. After the crude has been contacted with the hypochlorite solution it is treated subsequently by deasphalting with a conventional deasphalting solvent. The hydrocarbon product obtained from the deasphalting step is a demetallized crude oil stock which is highly suitable for many conventional refinery processes such as hydrocracking. Most of the metals will be carried off in the asphaltene fraction.

DETAILED DESCRIPTION OF THE INVENTION

For purposes of the present invention the term "heavy hydrocarbon oil" is meant to include petroleum oil residua and oil sand bitumen feedstocks in which mixtures at least 75 wt.% of the constituents have a boiling point above about 700° F. Particularly a heavy hydrocarbon oil suitable for treatment in accordance with the present invention has a metals content of at least 10 ppm and a Conradson Carbon Residue content of at least 2 wt.%.

In one aspect of the present invention an aqueous solution of hypochlorite such as sodium or calcium hypochlorite is introduced into a contact zone where it is intimately mixed with the residua oil being treated. Ultra sonic mixing is a preferred technique for combining these materials. Generally the concentration of hypochlorite salt (sodium, calcium, etc.) should be such as to provide between 1.0 and 2.0 grams available oxygen per 100 grams of oil, and preferably between 1.3 and 1.6. This corresponds, for example, to 3.4 g NaOCl (for 1% available oxygen) to 6.9 g NaOCl (for 2% available oxygen). When dealing with a 5% solution of commercial bleach (NaOCl solution), 70 cc bleach to 100 g oil corresponds to about 1% available oxygen while 140 cc bleach gives 2% available oxygen. It has been found that 45 wt.% $Ca(ClO)_2$ in $H_2O$ (9 g $Ca(ClO)_2$ in 20 g $H_2O$ contacted with 50 g oil) gives good results and a reduced volume of aqueous solution facilitates processing. The volume ratio of 5% hypochlorite solution to residua is between 70 and 50. Preferred hypochlorite compounds are the salts of metals of Groups IA and IIA of the Periodic Table. Group IA metals include lithium, sodium, potassium and rubidium. Group IIA metals include magnesium, calcium, strontium, and barium. Aqueous solutions of hypochlorous acid are also contemplated for use in this process. The most preferred hydrochlorite salts are sodium hypochlorite and calcium hypochlorite and of these, sodium hypochlorite is most preferred.

It is preferred that a contact time of from 1 to 24 hours be used for the oil-aqueous hypochlorite mixture and that the ratio of available oxygen to hydrocarbon oil being treated is at least 1.3 grams of available oxygen to 100 grams of oil. This is particularly true for an aqueous solution containing 5% NaOCl by weight. Available oxygen is defined as the grams oxygen in hypochlorite per 100 g oil. The mixture of fluids is then removed from the reactor zone into a settling zone where the fluids are allowed to settle and separate into two phases, an aqueous phase and an oil phase. Alternatively, any liquid-liquid separation process or equipment may be applied to this zone. The aqueous phase containing the spent hypochlorite solution and any metal contaminants is removed separately. The oil phase from the settler zone is removed to a separate zone where it is subjected to deasphalting fractionation with a light solvent. It is preferred that the deasphalting process be a liquid-liquid countercurrent contacting system. Suitable deasphalting solvents include liquified normally gaseous hydrocarbons such as ethane, ethylene, propane, propylene, n-butane, isobutane, n-butylene, isobutylene, pentane and isopentane, cyclohexane, hexane, heptane, decane, octane, nonane, decalin, and mixtures thereof.

In general the deasphalting solvent of choice is a liquid hydrocarbon containing between about 3–12 carbon atoms. The weight ratio of deasphalting solvent to treated oil normally will be in the range between about 0.5:1–15:1. The deasphalting treatment preferably is conducted at a temperature between about ambient to 500° F. and at a sufficient pressure to mantain the deasphalting solvent in liquid form and for a period between about 0.1–1.5 hours.

The liquid solvent extract phase and the precipitated asphaltic solids are withdrawn separately from the deasphalting zone. The solvent oil effluent is charged to an atmospheric distillation tower to strip off the deasphalting solvent. The distillation bottom fraction is a demetallized liquid hydrocarbon product. Metals content of the resulting liquid hydrocarbon product is less than about 10 ppm.

EXAMPLE I

An Arab heavy crude oil was used to demonstrate the upgrading potential of hypochlorite pretreatment before deasphalting. Arab heavy crude in the amount of 110 grams (approximately 120 cc) was mixed with 150 ml of sodium hypochlorite, a commercially available brand (with the pH adjusted to 8) estimated to contain a concentration of 7.5 g NaOCl. The two were mixed together thoroughly overnight. An emulsion was formed. This emulsion was then deasphalted by mixing it with pentane in a ratio of 15 volumes of pentane to 1 volume of oil. For this example about 1650 cc pentane were used on the emulsion. The pentane insoluble fraction recovered amounted to 15.9 wt.% of the total. The oil fraction recovered was reduced in metals content by 93.7% and the CCR was reduced 71%.

For comparison, a sample of untreated crude was subjected alone to deasphalting in the same proportions. The crude resulting was only 80 percent demetallized, and the Conradson Carbon content was reduced only 46 percent. The data obtained are summarized in the accompanying table. From this table it is readily apparent that the treatment with the hypochlorite resulted in a more readily improved hydrocarbon product.

TABLE 1

| Upgrading of Arab Heavy Crude | Untreated Arab Heavy Crude | NaOCl-treated Arab Heavy Crude |
|---|---|---|
| Oil: | | |
| Ni ppm | 19 | |
| V ppm | 57 | |
| CCR % | 7.3 | |
| *Deasphalted oil: | | |
| Ni ppm | 3.6 | 0.68 |
| V ppm | 11.5 | 4.13 |
| CCR % | 4.0 | 2.1 |
| wt % asphaltene | 15.9 | 15.9 |

TABLE 1-continued

| Upgrading of Arab Heavy Crude | Untreated Arab Heavy Crude | NaOCl-treated Arab Heavy Crude |
|---|---|---|
| % demetalation | 80 | 93.7 |
| % deCCR | 46 | 71 |

*15:1 pentane:oil Volume ratio

EXAMPLE II

In another test calcium hypochlorite was used. Nine (9) grams of calcium hypochlorite, $Ca(ClO)_2$ was dissolved in 20 cc of water and stirred with 50 grams of Arab heavy crude for 24 hours. The resultant emulsion was then deasphalted following the procedure described above. The resultant oil product was 96.1% demetallized and contained 11.4 wt.% asphaltenes.

Calcium hypochlorite provides an excellent alternative to the use of aqueous sodium hypochlorite solutions. It is a solid which need be mixed with water only immediately prior to use. It can be easily stored in dry form whereas sodium hypochlorite is not as stable in dry solid form. However, NaOCl (solid) can be stored dry in a dry carbon dioxide free environment for extended time.

Under the conditions of these experiments with rapid stirring at room temperature, at least 1–4 hours contact time between the oil and aqueous hypochlorite were needed to achieve greater than 90% demetallation. Under conditions of improved mixing and higher temperatures, and with the addition of promoters such as Ni, Co, Cu, Fe, Mn or Hg oxide gel, reaction time can be reduced. Also reagents that accelerate the decomposition of hypochlorite also aid in reducing reaction time, as for example, ammonium carbonate, oxalate, nitrate, acetate or phosphate. In addition, activators such as hydrogen peroxide enhance the oxidizing properties of hypochlorites and increase reaction rate. The amount of promoter gel, hypochlorite decomposition accelerator, and activator (hydrogen peroxide) can readily be determined by simple experimentation.

What is claimed is:

1. A process for demetallizing a residual hydrocarbon fraction comprising:

(a) contacting said hydrocarbon fraction with an aqueous solution of a hypochlorite salt;

(b) separating the mixture into an aqueous phase and an oil phase;

(c) contacting the oil phase with a deasphalting solvent and (d) obtaining by separation a product comprising a demetallized oil fraction suitable for use as a feedstock for catalytic processing.

2. The process of claim 1 wherein the volume ratio of an aqueous 5% hypochlorite solution to oil is between 70 to 140 cc of said solution to 100 g oil.

3. The process of claim 1 wherein the hypochlorite is selected from the group consisting of calcium hypochlorite and sodium hypochlorite.

4. The process of claim 1 wherein the concentration of hypochlorite salt in said aqueous solution is between about 1 and about 50% by weight.

5. The process of claim 1 wherein said contacting of said hypochlorite solution with hydrocarbon oil is conducted at a temperature between about 30° F. and about 200° F.

6. The process of claim 1 wherein the deasphalting solvent is selected from the group consisting of $C_2$ to $C_{15}$ hydrocarbons.

7. The process of claim 1 wherein the weight ratio of deasphalting solvent to oil phase is between 0.5:1 and about 15:1.

8. The process of claim 1 wherein the solvent deasphalting operation is carried out at a temperature between about 30° F. and about 500° F.

9. The process of claim 1 wherein the deasphalting operation is carried out at a pressure between about atmospheric and about 1000 psig.

10. The process of claim 1 wherein the ratio of available oxygen to hydrocarbon oil in the resultant mixture of (a) is at least 1 wt.% oxygen/100 g oil.

11. The process of claim 1 wherein the hypochlorite salt is a salt of a group IA metal.

12. The process of claim 1 wherein the Group IA metal is selected from the group consisting of lithium, sodium, potassium and rubidium.

13. The process of claim 1 wherein the hypochlorite salt is a salt of a Group IIA metal.

14. The process of claim 13 wherein the metal is selected from the group consisting of magnesium, calcium, strontium, and barium.

15. The process of claim 1 wherein the hypochlorite salt is substituted by hypochlorous acid.

16. The process of claim 1 wherein a gel of a metal selected from the group consisting of nickel, cobalt, copper, iron, manganese and mercury is also added to said aqueous solution.

17. The process of claim 1 wherein a hypochlorite decomposition accelerator selected from the group consisting of ammonium salts of carbonic oxalic, nitric, acetic or phosphoric acid is added to said aqueous solution.

18. The process of claim 1 wherein hydrogen peroxide is added to said aqueous solution.

19. The process of claim 1, wherein said contacting of said hydrocarbon fraction with said hypochlorite salt is for a time of from about 1 to 24 hours.

20. The process of claim 1, wherein said contacting of said oil phase with said deasphalting solvent is for a time of from 0.1 to 1.5 hours.

* * * * *